US005094358A

United States Patent [19]

Serio, Sr.

[11] Patent Number: 5,094,358

[45] Date of Patent: Mar. 10, 1992

[54] LOCKING MECHANISM FOR CONTAINER LID

[76] Inventor: Joseph L. Serio, Sr., 1503 W. St., Apt. B, Annapolis, Md. 21401

[21] Appl. No.: 659,988

[22] Filed: Feb. 26, 1991

[51] Int. Cl.[5] ..... B65D 45/00

[52] U.S. Cl. ..... 220/315; 220/908

[58] Field of Search ..... 220/260, 262, 263, 264, 220/315, 908

[56] References Cited

U.S. PATENT DOCUMENTS

| | | | |
|---|---|---|---|
| 3,731,837 | 5/1973 | Platts et al. | 220/315 |
| 4,152,979 | 5/1979 | Schmidt | 220/908 X |
| 4,182,530 | 1/1980 | Hodge | 220/908 X |
| 4,520,945 | 6/1985 | Hodge | 220/315 |
| 4,585,139 | 4/1986 | Bronson et al. | 220/256 |
| 4,609,117 | 9/1986 | Pamment | 220/908 X |
| 4,809,850 | 3/1989 | Laible et al. | 206/366 |

*Primary Examiner*—Stephen Marcus

*Assistant Examiner*—Nova Stucker

*Attorney, Agent, or Firm*—Longacre & White

[57] ABSTRACT

The invention is directed to a locking mechanism for a container having a hinged or removable lid. The elements of the locking mechanism comprise at least one L-shaped lock over arm mounted for pivotal rotation on a front side of the container, a locking bar for supporting the L- shaped lock over arm for pivotal rotation with the lock over arm being mounted for rotation on the first side of the container, and a locking bar rotation arresting means for securing the locking bar in a first position with the locking bar arresting means comprising a swing lever extending from the locking bar, and engaging a wedge assembly which wedges the swing lever against movement when the container is in an upright position. The wedging mechanism releases the locking bar rotation arresting means when the container is substantially forwardly tipped.

12 Claims, 6 Drawing Sheets

LOCKING MECHANISM FOR CONTAINER LID

FIELD OF THE INVENTION

The present invention relates to the field of locking mechanisms for container lids. Specifically, the invention relates to an automatic pivoting locking mechanism for locking in place the access openings of dumpster containers

BACKGROUND OF THE INVENTION

Many container lid locking mechanisms have been proposed. An example of a container lid locking system is disclosed in U.S. Pat. No. 4,534,488. While the many prior art container lid locking mechanisms have their uses, several shortcomings have become evident with respect to efficiently and effectively locking lids on large containers. Specifically, in the field of locking container lids for trash receptacles, there are few simple locking mechanisms, and even fewer retrofit mechanisms which can be applied to a broad variety of types and sizes of containers.

With the advent of mechanized trash removal, there have been created a number of large sized trash bins. These bins usually comprise a block shaped container with a hinged lid attached to one side thereof. The container further includes attachments for accommodating various forked lifting mechanisms of the trash removal vehicle. The containers are lifted by the lifting mechanism of the trash removal vehicle and pivoted in some fashion so that the hinged top of the container opens and the trash contained therein is emptied into the vehicle. The container is then returned to a position on the ground, and the hinged lid closes on top of the container.

Many of these large trash receptacles are rented from the trash removal service. These receptacles are not provided free of charge, and consequently their frequent emptying and service are sometimes a considerable expense. This expense is increased when unauthorized users of the receptacle freely deposit trash therein. This unauthorized use necessitates a more frequent emptying of the container, and of course the unauthorized user does not contribute to the increased expense.

For the foregoing reasons, there has existed a need to create a locking mechanism for these containers which is simple and reliable, and which can be originally and retrofitted to a broad variety of containers. While many of these containers are of all metal construction, and at that very fairly heavy gauge metal, many of the newer containers are of partial plastic construction or are of all plastic construction. Hence, the ability for a user or provider of the receptacle to attach a simple welded locking structure is limited owing to the fact that not all of the parts of the container can accommodate a weld.

Another problem of retrofitting existing containers or providing a broad application type of locking mechanism for variously sized containers is the question of custom sizing application. The solution to accommodating a broad size of containers is to create a locking mechanism which can be changed in dimension while not altering the basic operation of the locking mechanism.

The present invention seeks to obviate the shortcomings of the prior art container lid locking mechanisms, while at the same time providing a solution to the need for a retrofit locking mechanism for a wide variety of container types, materials, and sizes.

SUMMARY OF THE INVENTION

The present invention comprises only a few basic elements which in combination serve to securely lock in place a removable or hinged container lid to a container. The elements of the automatic pivoting locking mechanism for a dumpster container having a hinged lid comprises at least one L-shaped lockover arm mounted for pivotal rotation at a pivot point on a front side of a dumpster container, a locking bar for supporting said L-shaped lockover arm for pivotal rotation, the lockover arm being mounted for rotation at the pivot point on the front side of the container, and a locking bar rotation arresting means for securing the locking bar in a first position. The arresting means comprises a swing lever extending from the locking bar, and engaging a wedge assembly which wedges the swing lever against movement when the container is in anupright position. The wedging mechanism releases the locking bar for rotation when the container is substantially forwardly tipped. The locking bar is usually contained in a cover. The wedge assembly can be either a hinged wedged plate or a ball trigger. A stop welded to a top lid of the cover to restrict the unlocked position of the arresting means so that the lockover arm is kept to the inside of the pivot point.

The L-shaped lockover arm can be further comprised of a longitudinally extended locking bar which passes through the end of the free end of the L-shaped lockover arm, with the locking bar extending substantially along the length of the dumpster container to another pivoting attachment point on the container. A pivot bar can also extend through the pivot point of the lockover bar and along the front of the dumpster container. A pivot shaft can be positioned through the pivot point of the cover, the L-shaped lockover arm and through the pivot bar.

In another embodiment of the invention, a hole through the pivot bar and the pivot shaft allows for the positioning of a lock to lock the pivot bar in place with respect to the lockover arm, allowing the L-shaped lockover arm to be secured atop a lid of the dumpster container selectively to allow user access to the container.

In yet another embodiment of the invention, a second cover on the other side of the front of the dumpster container allows for the ends of the locking bar and the pivot bar to be completely contained and provided with a pair of wedging mechanisms to stop the motion of the lockover bar.

The container can be either all metal or the top of the container can be made of plastic or some other light weight material.

DETAILED DESCRIPTION OF THE PREFERRED EMBODIMENTS

Figure 1:
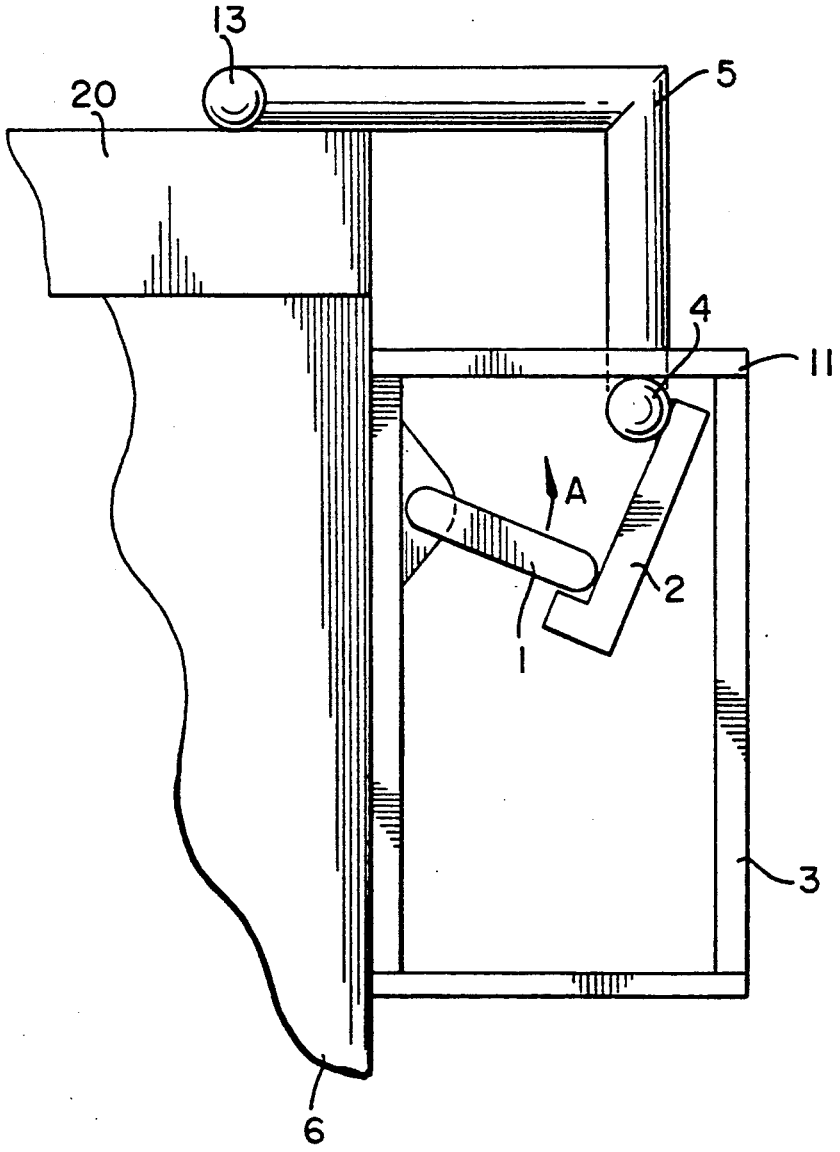
FIG. 1 is a cross-sectional view taken along line I—I in FIG. 6 showing a locking mechanism equipped with a wedge plate according to the present invention.

Referring more specifically to the drawings, FIG. 1 shows an automatic pivoting locking mechanism for a dumpster container 6 having a hinged lid 20 and using hinged wedge plate 1 for the wedge assembly. When the dumpster container 6 is substantially forwardly pivoted, the hinged wedge plate swings in the direction of arrow A shown in FIG. 1 This then allows the swing lever 2 to swing upwards, or more correctly towards the top 11 of the cover 3. Since the swing lever is connected to the locking bar 4, the locking bar 4 is rotated. This in turn rotates the L-shaped lockover arm 5 which has been securing the hinged lid 20 of the dumpster container 6, thereby allowing the lid 20 to swing open, permitting the contents of the dumpster container 6 to be emptied.

Figure 2:
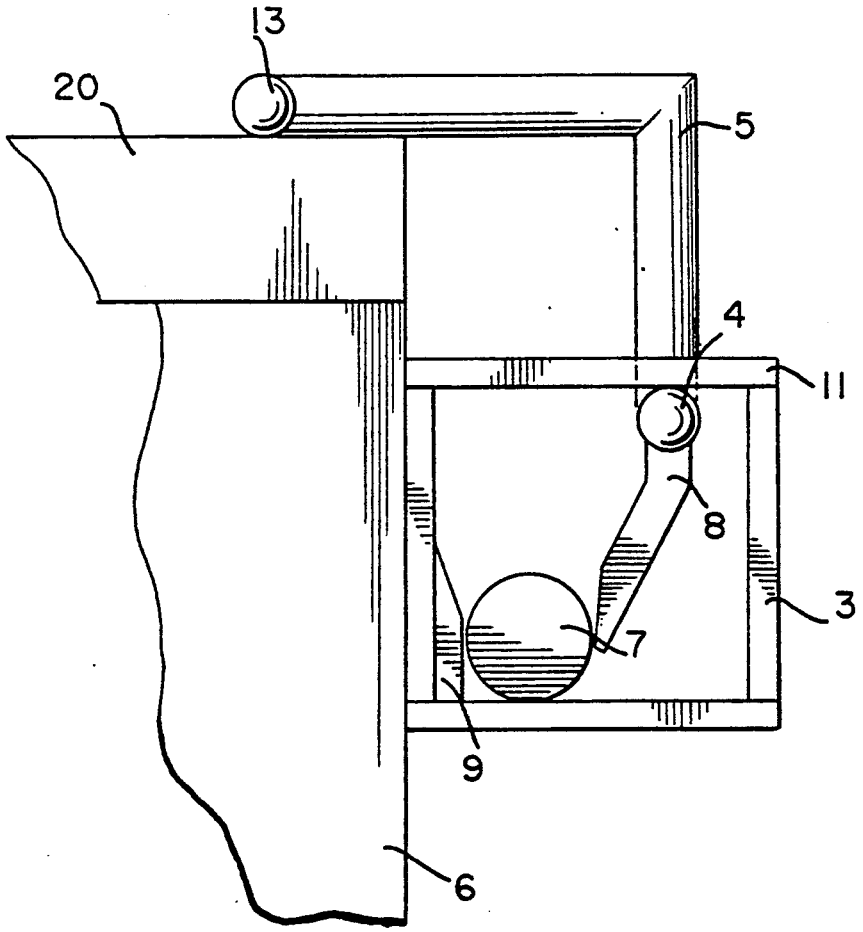
FIG. 2 is a cross-sectional view similar to that of FIG. 1 showing another embodiment of the locking mechanism according to the present invention.
Figure 3:
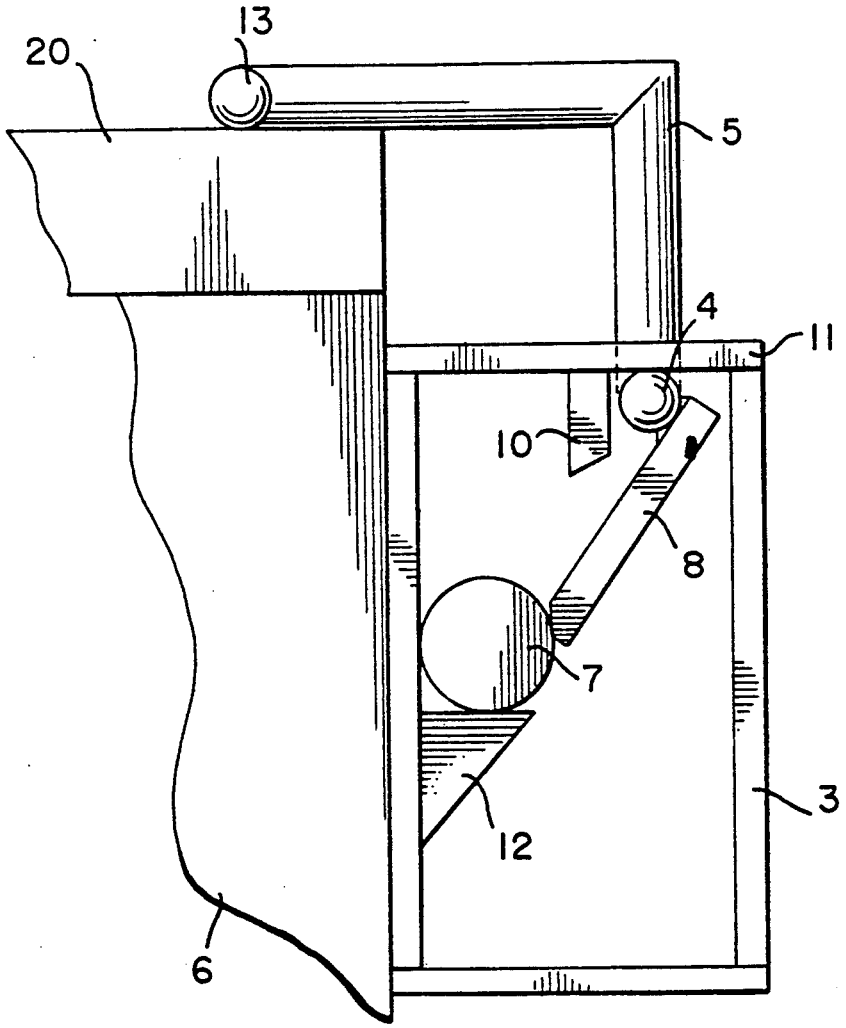
FIG. 3 is a cross-sectional view similar to that of FIG. 1 showing an embodiment of the present invention in the locked position.
Figure 4:
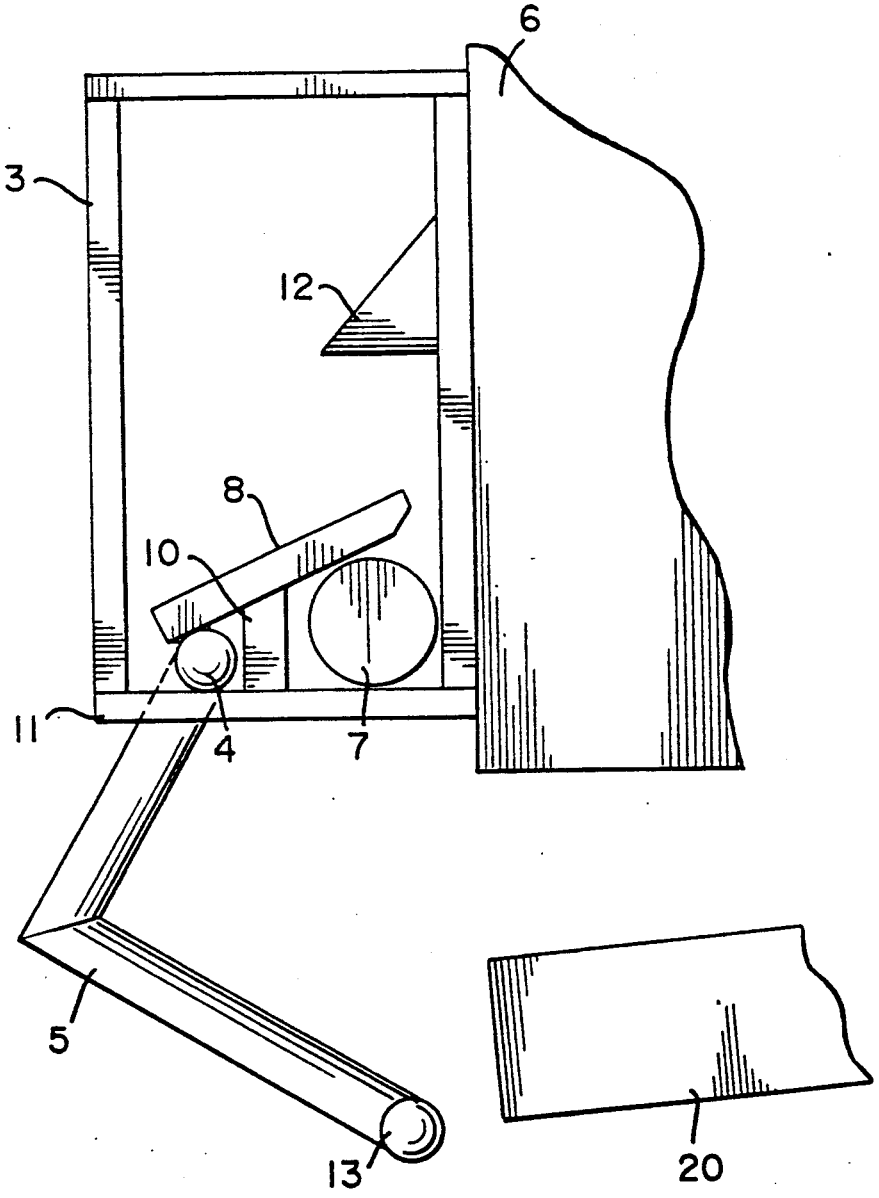
FIG. 4 is a cross-sectional view similar to that of FIG. 1 showing an embodiment of the present invention in the unlocked position.
Figure 5:
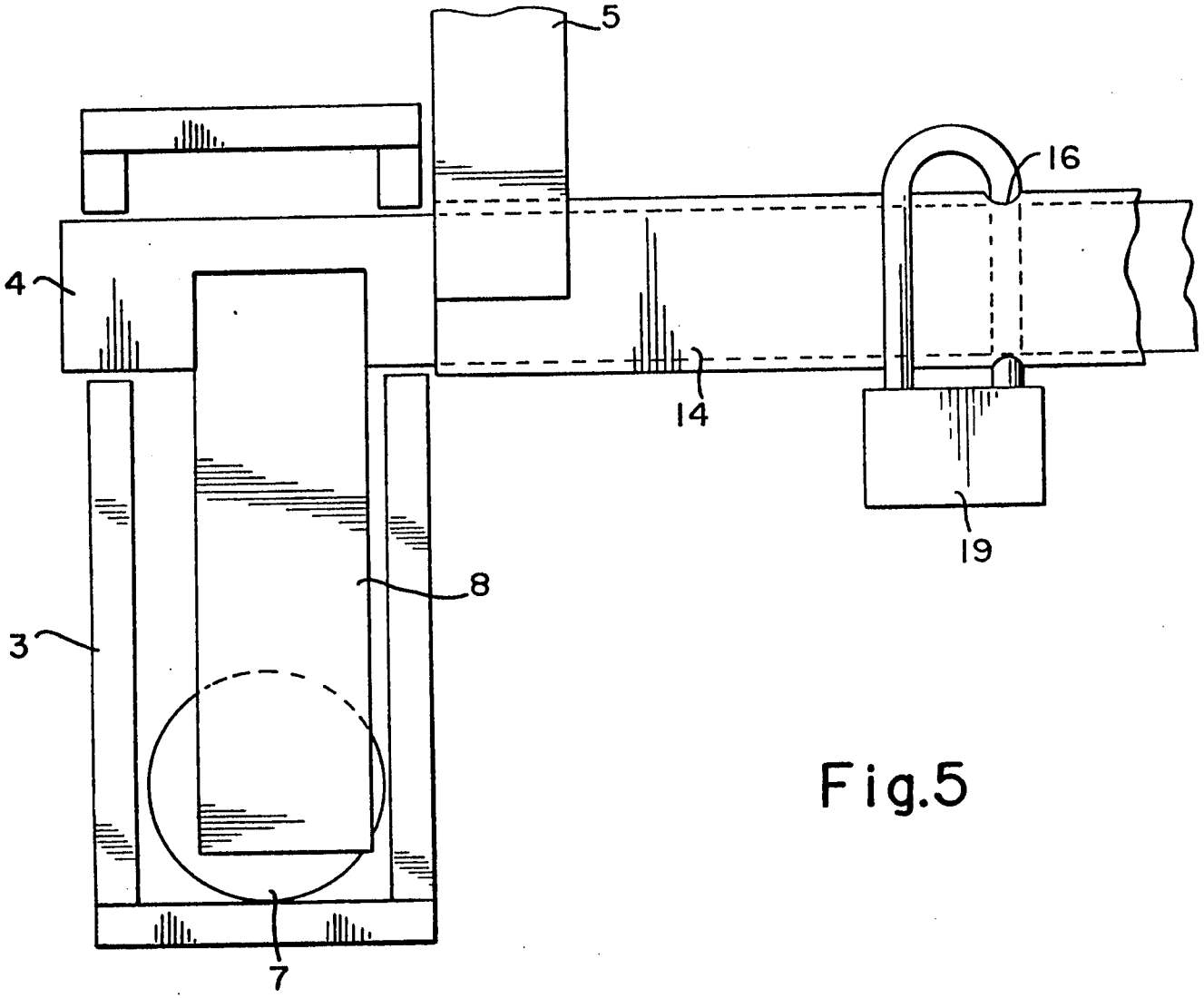
FIG. 5 is a cross-sectioned view taken along line V—V in FIG. 6 showing a detail of the present invention.
Figure 6:
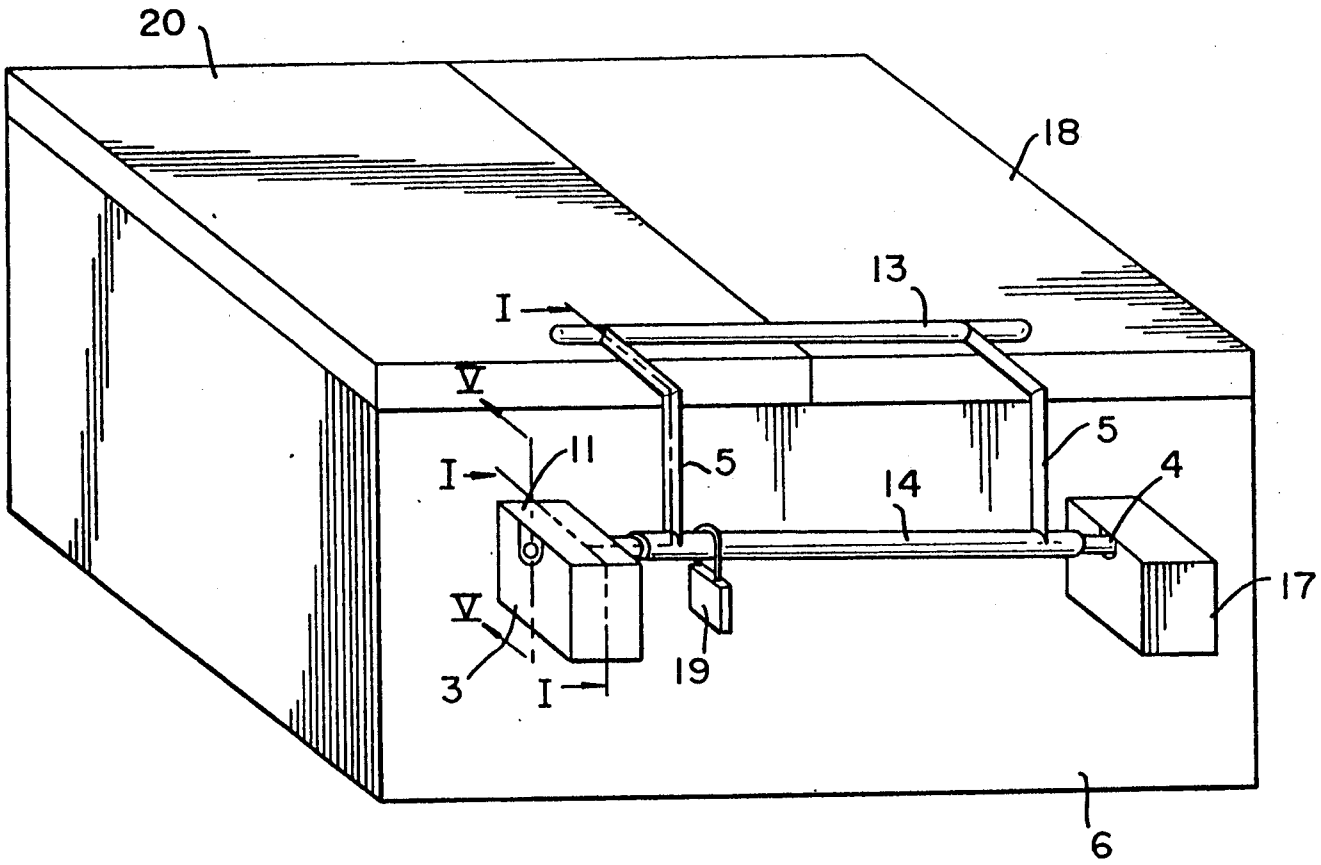
FIG. 6 is a isometric frontal view of a dumpster container with an embodiment of the present invention.

In another embodiment of the invention, a ball trigger 7 is used instead of a hinged wedge plate 1 (FIGS. 2–4). As the dumpster container is tilted forward toward the position shown in FIG. 4, the ball trigger 7, which, when the dumpster container is in an upright position (FIG. 3), is positioned between a tapered filler 9 and a tapered swing lever 8, rolls along the tapered swing lever 8. As with the swing lever in FIG. 1, the tapered swing lever 8 swings towards the top 11 of the cover 3 thereby removing the L-shaped lockover arm 5 from on top of the lid 20 of the dumpster container 6.

When the ball trigger 7 is used, it is advantageous as shown in FIGS. 3 and 4 to have a stop 10 welded to the top 11 of the cover 3 to restrict the unlocked position of the arresting means so that the lockover arm 5 is kept to the side of the locking bar 4. In another embodiment of this invention, the ball trigger 7 may rest on a platform 12 when the arresting mean is in the locked position (FIG. 3).

In a further embodiment of the invention, an elongated blocking bar 13 passes through the free end of the L-shaped lockover arm 5, extending substantially across the length of the dumpster container 6. Additionally, a pivot shaft 14 may circumscribe the locking bar 4 and extend along the front of the dumpster container 6. The pivot shaft 14 being fixed to the L-shaped lockover arm 5. A hole 16 drilled through the locking bar 4 and the pivot shaft 14 allows for a padlock 19 to be attached, thereby locking the automatic pivoting locking position in a closed position.

A second cover 17 may be attached to the dumpster container, allowing the pivot shaft 14 to extend securely across the front of the dumpster container 6. The dumpster container 6 and its lid 18 may be made out of all metal, or the lid 18 may be nonmetal.

Further variations of the present invention will occur to those skilled in the art, and the embodiments described above are not in any way intended to limit the scope of this invention.

What is claimed is:

1. An automatic pivoting locking mechanism for a dumpster container having a hinged lid, said locking mechanism comprising:

at least one L-shaped lockover arm mounted for pivotal rotation about a pivot axis on a front side of said container;

a locking bar supporting said L-shaped lockover arm for pivotal rotation about said pivot axis on said front side of said container; and a locking bar rotation arresting means for securing said locking bar in a locking position, said arresting means comprising a swing lever extending from said locking bar which is engageable by a wedge assembly for wedging said swing lever against movement when said container is in an upright position, said wedge assembly releasing said locking bar to enable rotation about said pivot axis when said container is substantially forwardly pivoted.

2. An automatic pivoting locking mechanism according to claim 1, wherein said locking bar rotation arresting means is contained within a cover.

3. An automatic pivoting locking mechanism according to claim 2, wherein said wedge assembly comprises a hinged wedge plate.

4. An automatic pivoting locking mechanism according to claim 2, wherein said wedge assembly comprises a ball trigger.

5. An automatic pivoting locking mechanism according to claim 4, further comprising a stop welded to a top of said cover to restrict an unlocked position of the arresting means so that said lockover arm is kept to a side of said pivot axis.

6. An automatic pivoting locking mechanism according to claim 2, further comprising a second cover with said locking bar extending between said covers.

7. An automatic pivoting locking mechanism according to claim 1, wherein said L-shaped lockover arm further comprises an elongated blocking bar which is fixed to a free end of the L-shaped lockover bar distal from said locking bar, said blocking bar extending substantially along the length of said dumpster container.

8. An automatic pivoting locking mechanism according to claim 1, further comprising a pivot shaft circumscribing the locking bar and extending along said front of said container.

9. An automatic pivoting locking mechanism according to claim 8, wherein said L-shaped lockover arm is fixed to said pivot shaft.

10. An automatic pivoting locking mechanism according to claim 8, further comprising a hole through said locking bar and said pivot shaft, wherein a lock can be positioned through said hole to secure said pivot shaft and said L-shaped lockover arm in said locking position.

11. An automatic pivoting locking mechanism according to claim 1, wherein said container is of all metal construction.

12. An automatic pivoting locking mechanism according to claim 1, wherein said container sidewalls and bottom are of all metal construction and said moveable lid is of non-metal construction.

* * * * *